US008862040B2

(12) United States Patent
Okabe et al.

(10) Patent No.: US 8,862,040 B2
(45) Date of Patent: Oct. 14, 2014

(54) FIXING DEVICE AND IMAGE FORMING APPARATUS

(75) Inventors: Koji Okabe, Kanagawa (JP); Yasutaka Gotoh, Kanagawa (JP); Yuki Kubota, Kanagawa (JP); Takayuki Ryu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 264 days.

(21) Appl. No.: 13/552,942

(22) Filed: Jul. 19, 2012

(65) Prior Publication Data

US 2013/0251420 A1 Sep. 26, 2013

(30) Foreign Application Priority Data

Mar. 23, 2012 (JP) ..... 2012-066644

(51) Int. Cl.
*G03G 15/20* (2006.01)

(52) U.S. Cl.
USPC ..... 399/329

(58) Field of Classification Search
CPC ..... G03G 2215/2064; G03G 2215/2061; G03G 2215/2035; G03G 2215/2058; G03G 2215/2041
USPC ..... 399/329, 328, 331, 330; 219/216, 219/469–471
See application file for complete search history.

(56) References Cited

U.S. PATENT DOCUMENTS

| | | | | | |
|---|---|---|---|---|---|
| 3,884,623 | A * | 5/1975 | Slack | 219/216 |
| 4,961,704 | A * | 10/1990 | Nemoto et al. | 219/216 |
| 5,319,430 | A * | 6/1994 | DeBolt et al. | 399/331 |
| 5,689,789 | A * | 11/1997 | Moser | 399/331 |
| 6,775,509 | B2 * | 8/2004 | Shida et al. | 399/328 |
| 7,271,371 | B2 * | 9/2007 | Takematsu et al. | 399/328 |
| 7,447,474 | B2 * | 11/2008 | Fujino | 399/329 |
| 7,813,686 | B2 * | 10/2010 | Yagi et al. | 399/328 |
| 2005/0185995 | A1 * | 8/2005 | Akita et al. | 399/328 |

FOREIGN PATENT DOCUMENTS

| | | | |
|---|---|---|---|
| JP | 2006-301401 | A | 11/2006 |
| JP | 2010-014904 | A | 1/2010 |

* cited by examiner

*Primary Examiner* — Susan Lee
(74) *Attorney, Agent, or Firm* — Sughrue Mion, PLLC

(57) ABSTRACT

A fixing device includes a fixing member that is rotatable and heated by a heater; an endless belt member that is rotatable while being in contact with the fixing member; and a pressing member that is disposed inside of the belt member. The pressing member presses the fixing member with the belt member therebetween so as to form a fixing nip between the fixing member and the belt member, the fixing nip allowing a recording medium to pass therethrough to fix a toner image onto the recording medium. In an output region of the fixing nip from which the recording medium is output from the fixing nip, a curvature of a cross-sectional shape of an end portion of the belt member in a width direction is larger than a curvature of a cross-sectional shape of a middle portion of the belt member in the width direction.

10 Claims, 6 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2012-066644 filed Mar. 23, 2012.

BACKGROUND

Technical Field

The preset invention relates to a fixing device and an image forming apparatus.

SUMMARY

According to an aspect of the invention, a fixing device includes a fixing member that is rotatable and heated by a heater; an endless belt member that is rotatable and disposed so as to be in contact with the fixing member; and a pressing member that is disposed inside of the belt member, the pressing member pressing the fixing member with the belt member therebetween so as to form a fixing nip between the fixing member and the belt member, the fixing nip allowing a recording medium to pass therethrough to fix a toner image onto the recording medium. In an output region of the fixing nip from which the recording medium is output from the fixing nip, a curvature of a cross-sectional shape of an end portion of the belt member in a width direction is larger than a curvature of a cross-sectional shape of a middle portion of the belt member in the width direction.

BRIEF DESCRIPTION OF THE DRAWINGS

An exemplary embodiment of the present invention will be described in detail based on the following figures, wherein.

DETAILED DESCRIPTION

Hereinafter, an exemplary embodiment of the present invention will be described with reference to the drawings.

Figure 1:
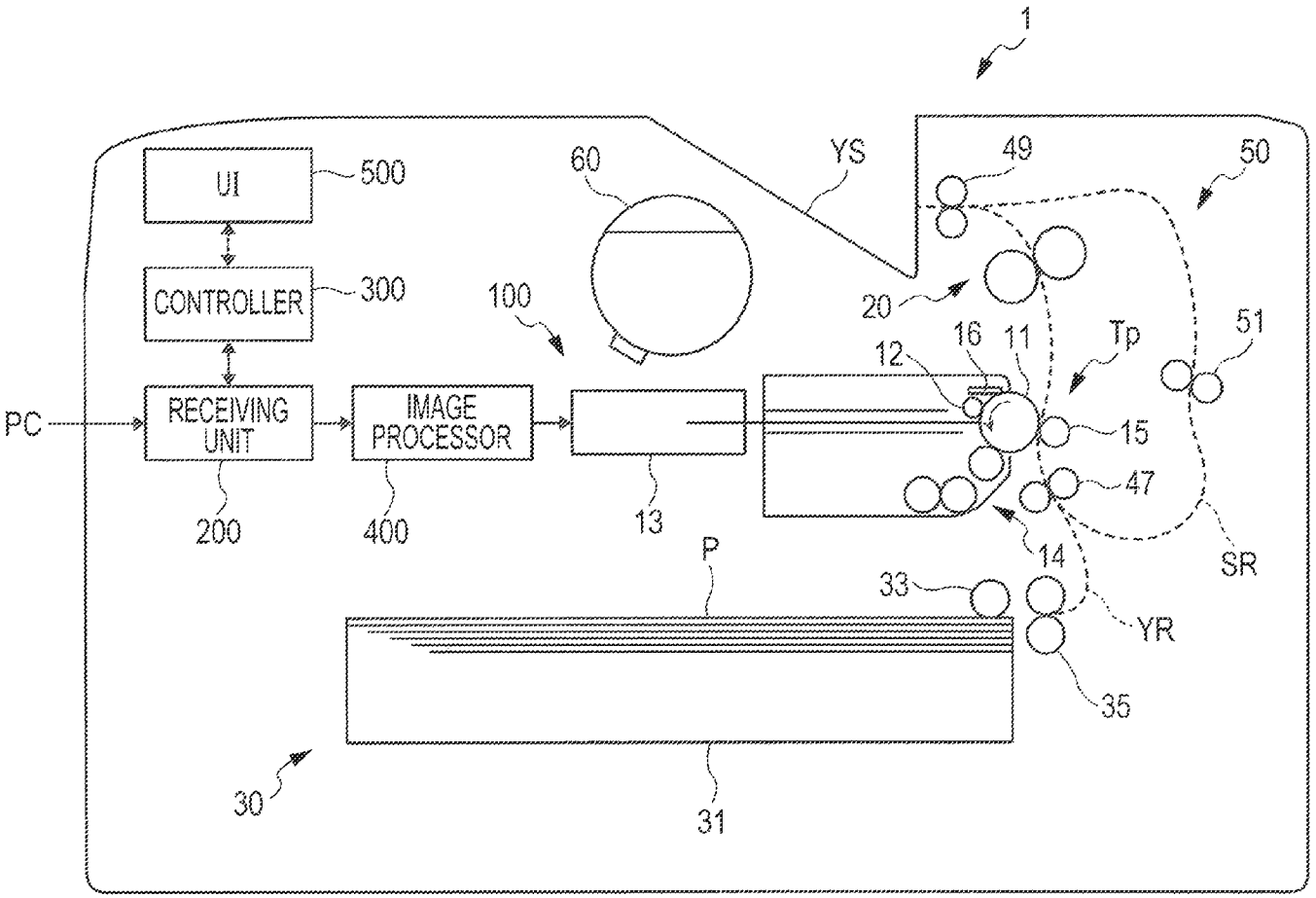
FIG. 1 is a schematic view illustrating an example of the structure of an image forming apparatus including a fixing device according to the exemplary embodiment.

FIG. 1 is a schematic view illustrating an example of the structure of an image forming apparatus 1 including a fixing device 20 according to the exemplary embodiment. As illustrated in FIG. 1, the image forming apparatus 1 includes an image forming unit 100, a controller 300, a sheet feeding unit 30, a sheet reversing mechanism 50, and a sheet stacker YS, and a toner cartridge 60. The image forming unit 100 forms an image on a sheet P on the basis of image formation. The controller 300 controls the overall operation of the image forming apparatus 1. The sheet feeding unit 30 supplies the sheet P to the image forming unit 100. The sheet reversing mechanism 50 flips the sheep P, on which the image forming unit 100 has formed an image, and then supplies the sheet P to the image forming unit 100 again. The sheet P, on which the image has been formed, is stacked on the sheet stacker YS. The toner cartridge 60 supplies toner to the image forming unit 100. The image forming apparatus 1 further includes a receiving unit 200, an image processor 400, and a user interface (UI) 500. The receiving unit 200 communicates with, for example, a personal computer (PC) and receives image data. The image processor 400 performs predetermined image processing on the image data received by the receiving unit 200. The user interface (UI) 500 accepts a command input from a user and displays a message to the user.

The image forming apparatus 1 according to the exemplary embodiment includes a sheet transport path YR along which a sheet is transported from the sheet feeding unit 30, through a transfer region Tp and the fixing device 20, and to the sheet stacker YS. The image forming apparatus 1 further includes a reverse transport path SR that is connected to the sheet transport path YR at a position downstream of the fixing device 20 and at a position upstream of the transfer region Tp. After the sheet P has been flipped by the sheet reversing mechanism 50, the sheet P is transported to the image forming unit 100 again through the reverse transport path SR.

The image forming unit 100 according to the exemplary embodiment includes a photoconductor drum 11, a charger 12, an exposure device 13, a developing device 14, and a cleaning device 16. The photoconductor drum 11, which has a photosensitive layer on a surface thereof, forms an electrostatic latent image and carries a toner image. The charger 12 charges the photoconductor drum to a predetermined potential. The exposure device 13 exposes the photoconductor drum 11, which has been charged by the charger 12, to light on the basis of image data. The developing device 14 develops an electrostatic latent image formed on the photoconductor drum 11. The cleaning device 16 cleans the surface of the photoconductor drum 11 after a toner image has been transferred.

The image forming unit 100 further includes a transfer device 15 and the fixing device 20. The transfer device 15, which is an example of a transfer unit, forms the transfer region Tp between the transfer device 15 and the photoconductor drum 11, and transfers a toner image formed on the photoconductor drum 11 to the sheet P. The fixing device 20, which is an example of a fixing unit, fixed the toner image, which has been transferred to the sheet P, onto the sheet P.

The image forming unit 100 further includes a registration roller 47, an output roller 49, and a transport roller 51.

The registration roller 47 temporarily stops rotating and transporting the sheet P and restarts rotating with a predetermined timing, and thereby supplies the sheet P to the transfer region Tp while performing registration adjustment.

The output roller 49 is disposed downstream of the fixing device 20, and outputs the sheet P, on which a toner image has been fixed by the fixing device 20, toward the sheet stacker YS.

The transport roller 51 transports the sheet P, which has been flipped by the sheet reversing mechanism 50, to the registration roller 47 again.

The sheet feeding unit 30 according to the exemplary embodiment includes a sheet container 31, a pickup roller 33, and a separation mechanism 35. The sheet container 31 has, for example, a rectangular-parallelepiped shape that is open upward, and contains plural sheets P. The pickup roller 33 feeds the sheets P that are positioned in an upper area of the sheet container 31 toward the separation mechanism 35. The separation mechanism 35 separates the sheets P, which have been fed from the pickup roller 33, into individual sheets P and transports the sheets P one by one toward the registration roller 47.

Next, an image forming process performed by the image forming apparatus 1 according to the exemplary embodiment will be described.

First, the receiving unit 200 receives image data that has been generated by a PC or the like, and the receiving unit 200 outputs the image data to the image processor 400. The image processor 400 performs image processing on the image data, which has been output to the image processor 400, and outputs the image data to the exposure device 13. The exposure device 13 obtains the image data, selectively exposes the photoconductor drum 11, which has been charged by the charger 12, to light on the basis of the obtained image data, and forms an electrostatic latent image. The developing device 14 develops the electrostatic latent image, which has been formed on the photoconductor drum 11, into, for example, a black (K) toner image.

In the sheet feeding unit 30, the pickup roller 33 rotates in accordance with the timing of the image forming operation, and the sheet P is supplied from the sheet container 31. The sheet P, which has been individually separated by the separation mechanism 35, is transported to the registration roller 47, which temporarily stops the sheet P. Subsequently, the registration roller 47 rotates in synchronism with the rotation of the photoconductor drum 11, and supplies the sheet P to the transfer region Tp. In the transfer region Tp, the toner image, which has been formed on the photoconductor drum 11, is transferred to the sheet P.

Subsequently, the fixing device 20 fixes the toner image, which has been transferred to the sheet P, onto the sheet P, and the output roller 49 outputs the sheet P to the sheet stacker YS. When forming an image on a second surface as well as on a first surface of the sheet P (on both side of the sheet P), after the sheet P has passed the fixing device 20, the sheet reversing mechanism 50 flips the sheet P and then supplies the sheet P to the transfer region Tp again. Then, a toner image that has been formed on the photoconductor drum 11 in the transfer region Tp is transferred to the second surface of the sheet P. Subsequently, the fixing device 20 fixes the toner image, which has been formed on the second surface of the sheet P, onto the second surface, and the output roller 49 outputs the sheet P to the sheet stacker YS.

Thus, the image forming apparatus 1 performs image forming operation the number of times corresponding to the number of sheets to be printed.

Next, the fixing device 20 according to the exemplary embodiment will be described.

Figure 2A:
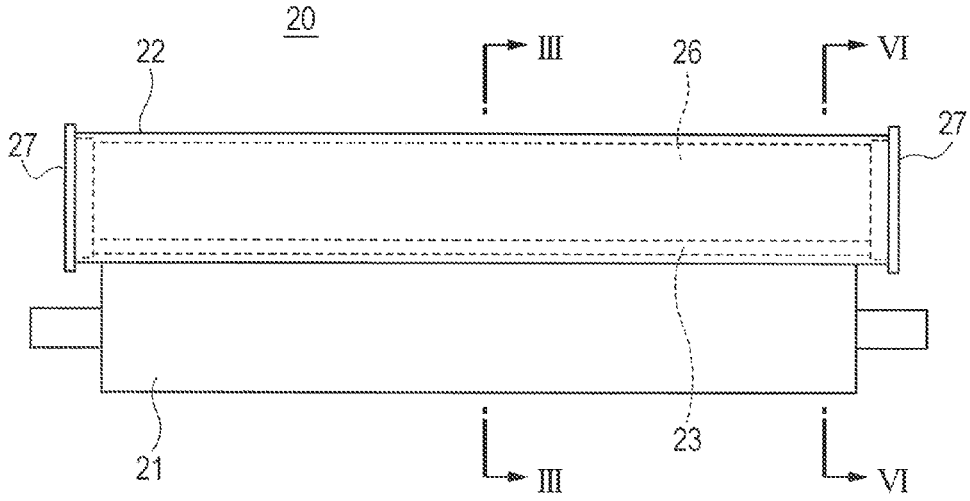
FIGS. 2A and 2B illustrate the structure of the fixing device according to the exemplary embodiment.
Figure 2B:
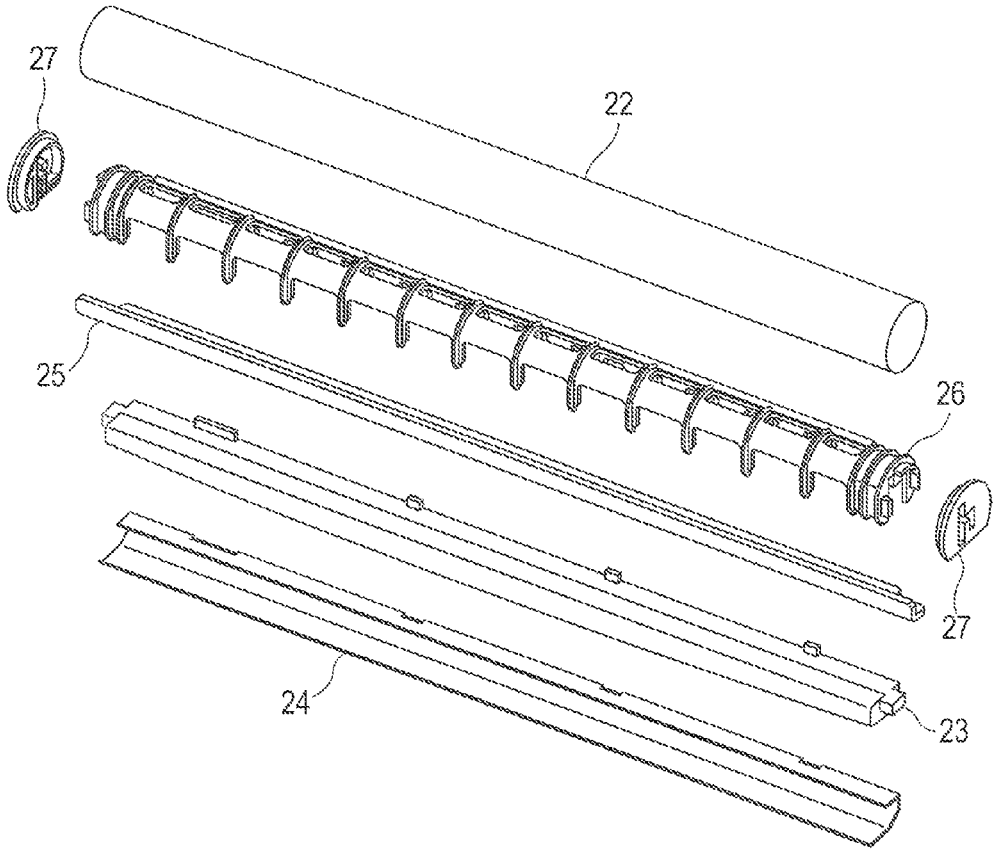
Figure 3:
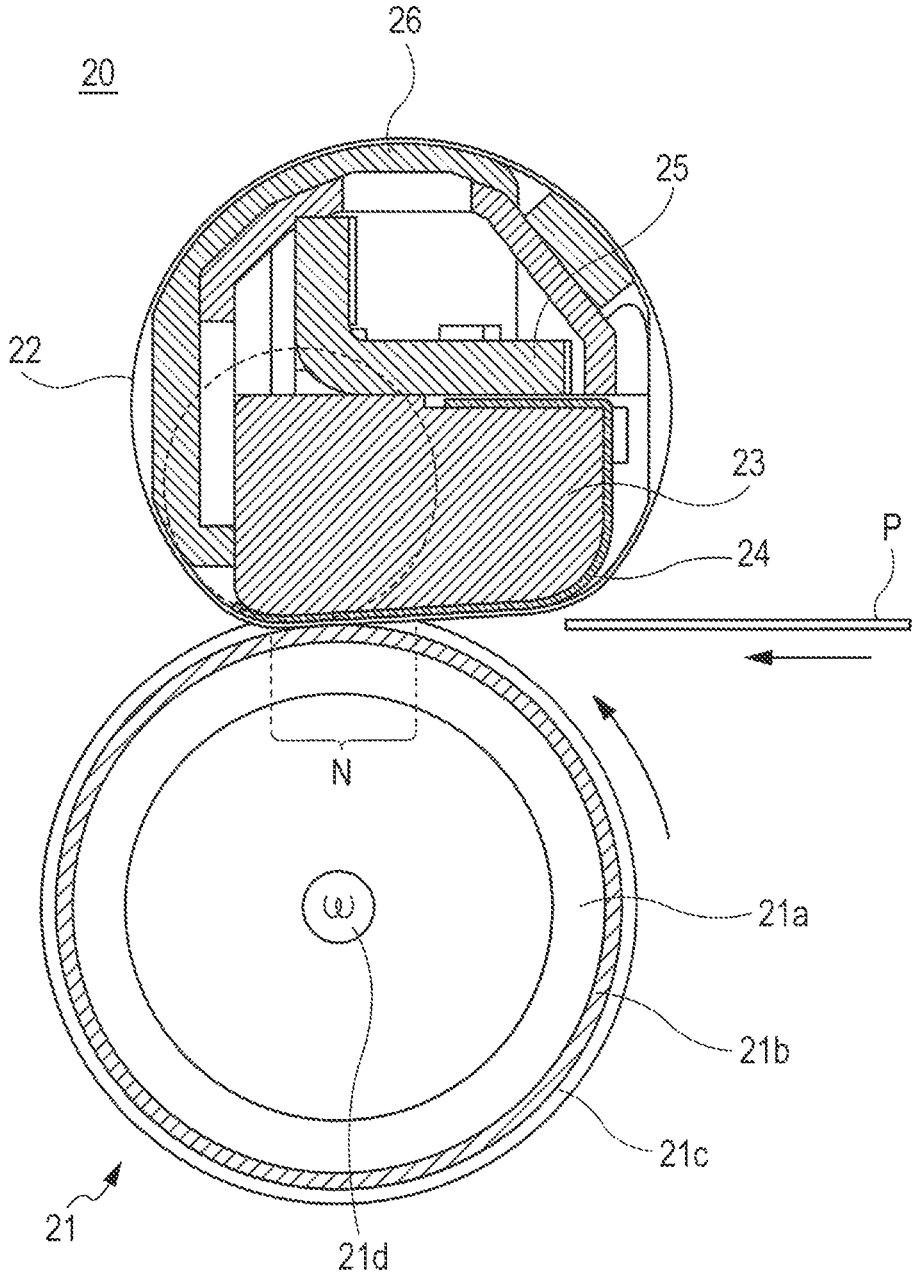
FIG. 3 is a cross-sectional view taken along line III-III of FIG. 2A.

FIGS. 2A and 2B illustrate the structure of the fixing device 20 according to the exemplary embodiment. FIG. 2A is a front view of the fixing device 20, and FIG. 2B is an exploded view of the fixing device 20. In FIG. 2B, a fixing roller 21 is not illustrated. FIG. 3 is a cross-sectional view taken along line III-III of FIG. 2A.

As illustrated in FIG. 2A, the fixing device 20 includes the fixing roller 21 and a pressure belt 22. The fixing roller 21 is an example of a fixing member. The pressure belt 22, which is an example of a belt member, is an endless belt that is disposed so as to be in contact with the outer peripheral surface of the fixing roller 21 to form a nip N (see FIG. 3) between the pressure belt 22 and the fixing roller 21.

As illustrated in FIGS. 2B and 3, the fixing device 20 further includes a pressing pad 23, a pad support member 25, a belt support member 26, and end cap members 27. The pressing pad 23, which is an example of a pressing member, is disposed inside of the pressure belt 22 and presses the fixing roller 21 with the pressure belt 22 therebetween. The pad support member 25 is disposed between the pressure belt 22 and the pressing pad 23 and supports the pressing pad 23. The belt support member 26 supports the pressure belt 22 from the inside of the pressure belt 22 so as to keep the shape of the pressure belt 22. The end cap members 27 are disposed at both ends of the pressure belt 22 in the width direction and support both end portions of each of the pressure belt 22, the pressing pad 23, the pad support member 25, and the belt support member 26.

In the exemplary embodiment of the present invention, the width direction of the pressure belt 22, which intersects the sheet transport direction at the nip N, may be simply referred to as the width direction.

In the fixing device 20 according to the exemplary embodiment, the fixing roller 21 is rotated by a driving motor (not shown) in one direction (counterclockwise in FIG. 3) with a predetermined speed. The pressure belt 22 is rotated by the fixing roller 21 in one direction (clockwise in FIG. 3) as the fixing roller 21 rotates. That is, the pressure belt 22 receives a rotational driving force from the fixing roller 21 and rotates in synchronism with the fixing roller 21.

The fixing device 20 is configured such that the fixing roller 21 and the pressure belt 22 are separable from each other when removing jammed sheets.

The entirety of the fixing roller 21 has a cylindrical shape, and the diameter of the outer peripheral surface of the fixing roller 21 is, for example, 30 mm. The fixing roller 21 includes a cylindrical member 21*a*, an elastic material layer 21*b* covering the outer peripheral surface of the cylindrical member 21*a*, and a surface releasing layer 21*c* covering the outer peripheral surface of the surface releasing layer 21*c*. The cylindrical member 21*a* is made of a metal. The elastic material layer 21*b* is made of, for example, a silicone sponge. The surface releasing layer 21*c* is made of, for example, a tetrafluoroethylene perfluoroalkyl vinyl ether copolymer mixed with carbon (PFA).

A heater (heat source) 21*d* is disposed in a central portion of the cylindrical member 21*a* of the fixing roller 21. The heater 21*d* is, for example, a 570-watt halogen lamp.

The pressure belt 22 is an endless belt member having, for example, a cylindrical shape in its undeformed state. When the pressure belt 22 according to the exemplary embodiment is not deformed (and has a cylindrical shape), the pressure belt 22 has, for example, a diameter of 30 mm at a middle portion in the width direction and a length of 370 mm in the width direction. As described below in detail, when the pressure belt 22 according to the exemplary embodiment is in contact with the fixing roller 21, the cross-sectional shape of the middle portion of the pressure belt 22 in the width direction taken along a plane perpendicular to the width direction is different from those of end portions of the pressure belt 22 in the width direction. As illustrated in FIG. 3, the cross-sectional shape of the middle portion of the pressure belt 22 in the width direction includes an arc shape.

The pressure belt 22 includes, in order from the inner side, a base layer made from a sheet-like member having high heat resistance, an elastic layer formed on the base layer, and a surface releasing layer formed on the elastic layer and exposed on the outer peripheral surface of the pressure belt 22.

The base layer is made of a material having high flexibility, high mechanical strength, and high heat resistance. Examples of the material of the base layer include a fluorocarbon resin, a polyimide resin, a polyamide resin, a polyamide-imide resin, a polyether ether ketone (PEEK) resin, a polyether sulfone (PES) resin, a polyphenylene sulfide (PPS) resin, a PFA resin, a polytetrafluoroethylene (PTFE) resin, a hexafluoropropylene-tetrafluoroethylene copolymer (FEP), and the like. The base layer may have a thickness in the range of, for example, 10 to 150 μm or in the range of 30 to 100 μm.

The elastic layer is made of a silicone rubber, a fluorocarbon rubber, or a fluorosilicone rubber having high heat resistance and high heat conductivity. The elastic layer may have a thickness in the range of, for example, 10 to 500 μm or in the range of 50 to 300 μm.

The surface releasing layer is made of, for example, a PFA resin, a PTFE resin, a fluorocarbon resin, a silicone resin, a fluorosilicone rubber, or a silicone rubber.

As illustrated in FIGS. 2A to 3, the pressing pad 23 is disposed inside of the pressure belt 22 so as to extend along the inner periphery of the pressure belt in the width direction of the pressure belt 22. The pressing pad 23 presses the fixing roller 21 with the pressure belt 22 therebetween to form a nip N between the pressure belt 22 and the fixing roller 21.

Examples of the material of the pressing pad 23 include an elastic material, such as a silicone rubber or a fluorocarbon rubber, and a heat-resistant resin, such as a liquid crystal polymer (LCP) or a polyphenylene sulfide (PPS).

As described below in detail, in the exemplary embodiment, in a region in which the pressing pad 23 faces the fixing roller 21 with pressure belt 22 therebetween, the shape of a middle portion of the pressing pad 23 in the width direction of the pressure belt 22 is different from that of each of end portions of the pressing pad 23 in the width direction of the pressure belt 22. Therefore, in the exemplary embodiment, the shape of a middle portion of the nip N in the width direction is different from that of each of end portions of the nip N in the width direction.

In the exemplary embodiment, in a region in which the pressing pad 23 faces the fixing roller 21 with pressure belt 22 therebetween, the shape of the pressing pad 23 on the upstream side in the transport direction of the sheet P (an entry region into which a recording medium enters) is different from that of the pressing pad 23 on the downstream side in the transport direction of the sheet P (an output region from which the recording medium is output). Thus, in the exemplary embodiment, the shape of the nip N on the upstream side in the sheet transport direction is different from that on the downstream side in the sheet transport direction in both of the middle portion of the nip N in the width direction and the end portions of the nip N in the width direction.

As illustrated in FIGS. 2B and 3, a sliding sheet 24 is disposed between the pressing pad 23 and the pressure belt 22 in order to reduce friction between the pressing pad 23 and the pressure belt 22 at the nip N. The sliding sheet 24 is made of a material having a low friction coefficient and high abrasion resistance, such as a polyimide film or a glass fiber sheet impregnated with a fluorocarbon resin. A lubricant, such as an amino-modified silicone oil or a dimethyl silicone oil, is applied to the inner peripheral surface of the pressure belt 22. Thus, frictional resistance between the pressure belt 22 and the pressing pad 23 is reduced, and the pressure belt 22 rotates smoothly.

As illustrated in FIGS. 2B and 3, the pad support member 25 is disposed inside of the pressure belt 22 and supports the pressing pad 23. The pad support member 25 is made of a material having high rigidity so that the amount of deformation of the pressing pad 23 when the pressing pad 23 receives a pressing force from the fixing roller 21 via the pressure belt 22 becomes smaller than a predetermined amount.

As illustrated in FIGS. 2A to 3, the belt support member 26 is disposed inside of the pressure belt 22 so as to extend along the inner periphery of the pressure belt 22 in the width direction of the pressure belt 22. The cross-sectional shape of the belt support member 26 includes an arc shape that follows the inner peripheral surface of the pressure belt 22. The belt support member 26 is disposed so as to be in contact with the inner peripheral surface of the pressure belt 22, and thereby the belt support member 26 supports the position of the pressure belt 22 from the inner periphery of the pressure belt 22. As described below in detail, in the exemplary embodiment, the shape of a middle portion of the belt support member 26 in the width direction is different from that of each of end portions of the belt support member 26 in the width direction.

Next, a fixing operation performed by the fixing device 20 will be described.

When the image forming apparatus 1 (see FIG. 1) starts an operation of forming a toner image, electric power is supplied to a driving motor (not shown) for driving the fixing roller 21 of the fixing device 20 and to the heater 21*d* disposed inside of the fixing roller 21. Thus, the fixing roller 21 rotates while being heated, and the pressure belt 22 is rotated by the fixing roller 21. The fixing roller 21 is heated to a predetermined temperature; and the pressure belt 22, which is in contact with the fixing roller 21, is heated by the fixing roller 21.

The fixing roller 21 is heated to a fixing temperature of, for example, 180° C. When the fixing roller 21 has been heated to 180° C., the temperature of the surface of the pressure belt 22 is about 160° C.

Next, after the fixing roller 21 has been heated to a predetermined temperature, a sheet P, on which an unfixed toner image has been formed, is transported into the nip N formed between the fixing roller 21 and the pressure belt 22. In the nip N, the sheet P is transported such that a surface of the sheet P on which the unfixed toner image has been formed faces the fixing roller 21 and the opposite surface faces the pressure belt 22. In the nip N, the sheet P and the unfixed toner image formed on the sheet P are heated by the fixing roller 21 and pressed between the fixing roller 21 and the pressure belt 22, and thereby the toner image is fixed onto the sheet P. Subsequently, the sheet P, on which the toner image has been fixed, is peeled off the fixing roller 21 and the pressure belt 22, and the sheet P is transported to the sheet stacker YS (see FIG. 1), which is disposed in an output section of the image forming apparatus 1.

When forming an image on a second surface (back side) of the sheet P in addition to the first surface (front side) of the sheet P, another toner image is formed on the second surface of the sheet P after a toner image on the first surface has been fixed to the sheet P, and the sheet P is transported to the fixing device 20 again to fix the toner image on the second surface onto the sheet P.

When fixing the toner image on the second surface, in the nip N of the fixing device 20, the sheet P is transported such that the second surface of the sheet P, on which an unfixed toner image has been formed, faces the fixing roller 21 and the first surface, on which a fixed toner image has been formed, faces the pressure belt 22.

As described above, during the fixing operation, the fixing roller 21 is heated to a predetermined fixing temperature and the pressure belt 22, which is in contact with the fixing roller 21, is heated by the fixing roller 21. Therefore, when forming a toner image on the second surface of the sheet P in the nip N, an unfixed toner image formed on the second surface of the sheet P is heated by the fixing roller 21, and a fixed toner image formed on the first surface of the sheet P is heated again by the pressure belt 22. As a result, the fixed toner image on the first surface of the sheet P may become melted again.

If the fixed toner image on the first surface of the sheet P becomes melted again, the first surface of the sheet P is likely to stick to the pressure belt 22 facing the first surface. If the sheet P sticks to the pressure belt 22 and is transported in this state, the sheet P may become wound around the pressure belt 22 and may cause paper jam.

In the case of forming an image on only one surface (first or second surface) of the sheet P, if the surface releasing layer or another layer of the pressure belt 22 has been impaired, the sheet P may not be peeled off the pressure belt 22 and may become wound around the pressure belt 22.

In the nip N, the pressing pad 23 presses the fixing roller 21 via the pressure belt 22, and a pressure is also applied to the sheet P, which passes through the nip N, in a direction intersecting the sheet transport direction. The magnitude of a pressure applied to a middle portion of the sheet P in the width direction of the sheet P (a direction perpendicular to the transport direction of the sheet P) tends to be different from that of a pressure applied to each of end portions of the sheet P in the width direction. In the case where the magnitude of a pressure applied to the middle portion of the sheet P in the width direction is different from that of a pressure applied to each of the end portions of the sheet P in the width direction, the sheet P may become deformed due to the pressures, and thereby the position of the transported sheet P after the sheet P has passed through the nip N may differ between the middle portion in the width direction and the end portions in the width direction.

In particular, in the exemplary embodiment, in which the endless pressure belt 22 having an endless shape is pressed against a fixing member such as the fixing roller 21, portions of the sheet P near the end portions of the pressure belt 22 in the width direction are more likely to be transported along the pressure belt 22 than a portion of the sheet P near the middle portion of the pressure belt 22. As a result, the sheet P tends to become wound around the end portions of the pressure belt 22 in the width direction than around the middle portion of the pressure belt 22 in the width direction. On the other hand, as compared with the end portions of the pressure belt 22 in the width direction, at the middle portion of the pressure belt 22 in the width direction, the sheet P is more likely to be transported, instead of along the pressure belt 22, along the fixing roller 21 after the sheet P has passed through the nip N. As a result, the sheet P is less likely to become wound around the middle portion of the pressure belt 22 in the width direction than around the end portions of the pressure belt 22 in the width direction.

It may be possible to restrain the sheet P from becoming wound around the end portions of the pressure belt 22 in the width direction by, for example, making the surface releasing layer on the surface of the pressure belt 22 from a material having high releasability. However, in general, a material having high releasability is expensive, so that if such a material having high releasability is used as the surface releasing layer, the cost of the pressure belt 22 may increase. Moreover, in general, a material having high releasability has low abrasion resistance. Therefore, if a material having high releasability is used as the material of the surface releasing layer, the surface releasing layer may become abraded and unable to restrain the sheet P from becoming wound around the pressure belt 22.

To prevent this, in the exemplary embodiment, in order to restrain the sheet P from becoming wound around the end portions of the pressure belt 22 in the width direction, the pressure belt 22 is formed such that the cross-sectional shape (taken along a plane perpendicular to the rotation axis of the pressure belt 22) of the middle portion of the pressure belt in the width direction is different from that of each of the end portions of the pressure belt 22 in the width direction.

To be specific, in an output region of the nip N (on the downstream side of the nip N in the sheet transport direction), from which the sheet P is output from the nip N, the curvature of the cross-sectional shape of each of the end portions of the pressure belt 22 in the width direction is larger than the curvature of the cross-sectional shape of the middle portion of the pressure belt 22 in the width direction.

Figure 4A:
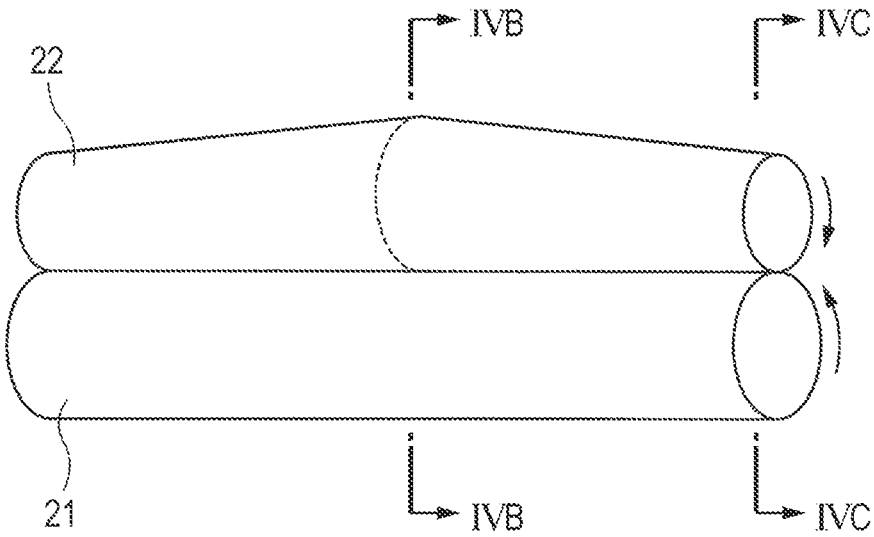
FIGS. 4A to 4C schematically illustrate a first shape of the pressure belt according to the exemplary embodiment.

Next, the shape of the pressure belt 22 according to the exemplary embodiment will be described with reference to schematic views. FIGS. 4A and 5C illustrate the shape of the pressure belt 22 according to the exemplary embodiment. FIGS. 4A and 5C are simple schematic views illustrating the structure of the pressure belt 22 and the fixing roller 21. The components of the fixing device 20 other than the pressure belt 22 and the fixing roller 21 are not illustrated.

In the following description, regarding the shapes of the end portions of the pressure belt 22, the shape of one of the end portions will be described. However, in the exemplary embodiment, the other end portion of the pressure belt 22 has the same shape. In the description below, the shape of a cross section of the pressure belt 22 will be referred to as the cross-sectional shape of the pressure belt 22.

First Shape of Pressure Belt 22

Figure 4B:
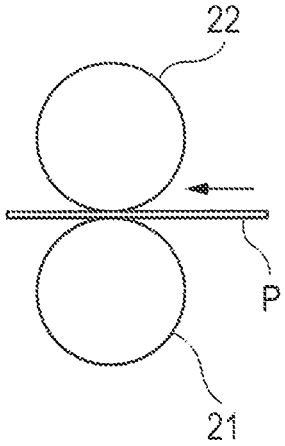
Figure 4C:
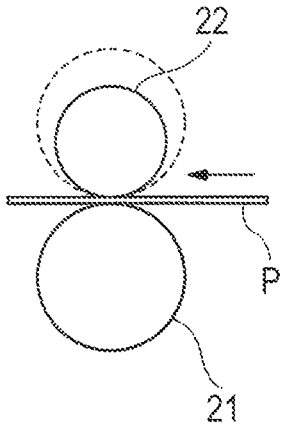

FIGS. 4A to 4C schematically illustrate a first shape of the pressure belt 22 according to the exemplary embodiment. FIG. 4A is a schematic perspective view illustrating the relationship between the pressure belt 22 and the fixing roller 21, FIG. 4B is a cross-sectional view taken along line IVB-IVB of FIG. 4A, and FIG. 4C is a cross-sectional view taken along line IVC-IVC of FIG. 4A. In FIG. 4C, a broken line illustrates the cross-sectional shape of the middle portion of the pressure belt 22 in the width direction, which is illustrated in FIG. 4B.

As illustrated in FIG. 4A, the pressure belt 22 has a so-called "crown shape" in that the diameter thereof gradually increases from end portions in the width direction toward a middle portion in the width direction.

As illustrated in FIG. 4B, the cross-sectional shape of the middle portion of the pressure belt 22 in the width direction includes an arc shape. The diameter d1 of the cross section of the middle portion the pressure belt 22 in the width direction is, for example, 30 mm. As illustrated in FIG. 4C, the cross-sectional shape of each of the end portions of the pressure belt 22 in the width direction includes an arc shape having a diameter smaller than that of the middle portion in the width direction. The diameter d2 of the cross section of each of the end portions of the pressure belt 22 in the width direction is, for example, 20 mm.

Thus, in this example, on the downstream side of the nip N in the sheet transport direction (in the output region), the curvature of the cross-sectional shape of each of the end portions of the pressure belt 22 in the width direction is larger than the curvature of the cross-sectional shape of the middle portion of pressure belt 22 in the width direction.

With such a structure, when the sheet P passes through the nip N, at the end portions of the pressure belt 22 in the width direction, the sheet P is unable to follow bending of the pressure belt 22 on the downstream side of the nip N in the sheet transport direction, so that the sheet P is more likely to be peeled off the surface of the pressure belt 22 due to the rigidity of the sheet P. Therefore, the sheet P is restrained from becoming wound around the end portion of the pressure belt 22 in the width direction.

On the downstream side of the nip N in the sheet transport direction, the curvature of the cross-sectional shape of the middle portion of the pressure belt 22 in the width direction is smaller than that of each of the end portions of the pressure belt 22 in the width direction. However, as described above, at the middle portion of the pressure belt 22 in the width direction, the sheet P is more likely to be transported along the fixing roller 21 and is less likely to be transported along the pressure belt 22 than at the end portions of the pressure belt 22 in the width direction. Therefore, as illustrated in FIG. 4B, even when the cross-sectional shape of the middle portion of the pressure belt 22 in the width direction includes an arc shape having a diameter larger than that of each of the end portions in the width direction and has a curvature smaller than that of each of the end portions in the width direction, the sheet P is less likely to become wound around the middle portion of the pressure belt 22 in the width direction.

It may be possible to restrain the sheet P from becoming wound around the end portions of the pressure belt 22 in the width direction by, for example, making the entirety of the pressure belt 22 have a cylindrical shape having a diameter d2 (at the end portions of the pressure belt 22 in the width direction according to the exemplary embodiment). However, if the entirety of the pressure belt 22 has a cylindrical shape having the diameter d2, the circumference of the pressure belt 22 at the middle portion in the width direction is smaller than that of the case where the pressure belt 22 has a crown shape as in the example described above. When the circumference of the pressure belt 22 is small, the surface of the pressure belt 22 passes the nip N with a higher frequency during a fixing operation, so that the surface of the pressure belt 22 is more likely to become abraded.

Therefore, when the pressure belt 22 has a so-called crown shape, abrasion of the middle portion of the pressure belt 22 in the width direction is reduced as compared with the case where the entirety of the pressure belt 22 has a cylindrical shape having a small diameter.

Second Shape of Pressure Belt 22

Next, a second shape of the pressure belt 22 will be described.

Figure 5A:
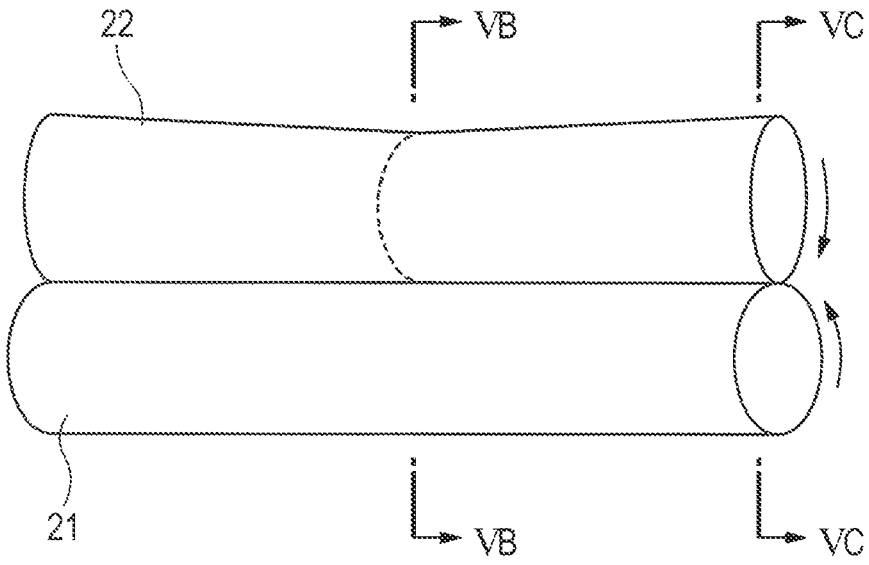
FIGS. 5A to 5C schematically illustrate a second shape of the pressure belt according to the exemplary embodiment.
Figure 5B:
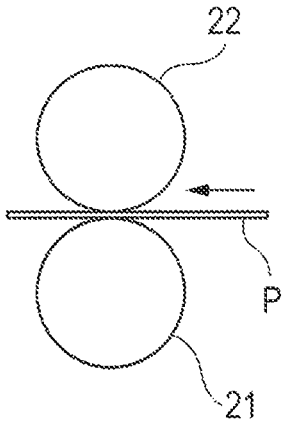
Figure 5C:
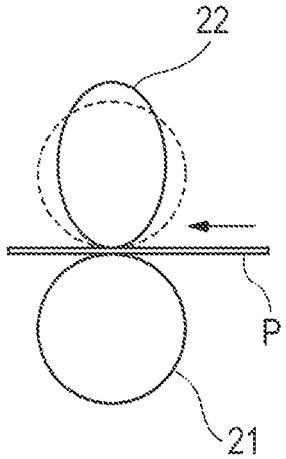

FIGS. 5A to 5C schematically illustrate the second shape of the pressure belt 22 according to the exemplary embodiment. FIG. 5A is a schematic perspective view illustrating the relationship between the pressure belt 22 and the fixing roller 21, FIG. 5B is a cross-sectional view taken along line VB-VB of FIG. 5A, and FIG. 5C is a cross-sectional view taken along line VC-VC of FIG. 5A. In FIG. 5C, a broken line illustrates the cross-sectional shape of the middle portion of the pressure belt 22 in the width direction, which is illustrated in FIG. 5B.

As illustrated in FIG. 5A, the shape of each of end portions of the pressure belt 22 in the width direction is different from that of a middle portion of the pressure belt 22 in the width direction.

To be specific, as illustrated in FIG. 5B, the cross-sectional shape of the pressure belt 22 in the width direction includes an arc shape. In the exemplary embodiment, the diameter d3 of the cross section of the middle portion of the pressure belt 22 in the width direction is, for example, 30 mm. As illustrated in FIG. 5C, the cross-sectional shape of each of the end portions of the pressure belt 22 in the width direction includes an elliptical arc shape having a minor axis extending along the sheet transport direction and a major axis extending perpendicular to the sheet transport direction. In this example, the length d4 of the major axis of the elliptic arc is, for example, 34 mm, and the length d5 of the minor axis is, for example, 26 mm in a cross section at each of the end portions of the pressure belt 22 in the width direction. In this example, the circumference of the middle portion of the pressure belt 22 in the width direction is substantially the same as that of each of the end portions of the pressure belt 22 in the width direction.

Thus, in this example, on the downstream side of the nip N in the sheet transport direction (in the output region), the curvature of the cross-sectional shape of each of the end portions of the pressure belt 22 in the width direction is larger than that of the middle portion of the pressure belt 22 in the width direction.

With such a structure, when the sheet P passes through the nip N, at the end portions of the pressure belt 22 in the width direction, the sheet P is unable to follow bending of the pressure belt 22 on the downstream side of the nip N in the sheet transport direction, so that the sheet P is more likely to be peeled off the surface of the pressure belt 22 due to the rigidity of the sheet P. Therefore, the sheet P is restrained from becoming wound around the end portions of the pressure belt 22 in the width direction.

On the downstream side of the nip N in the sheet transport direction, the curvature of the cross-sectional shape of the middle portion of the pressure belt 22 in the width direction is smaller than that of each of the end portions of the pressure belt 22 in the width direction. However, as described above, at the middle portion of the pressure belt 22 in the width direction, the sheet P is more likely to be transported along the fixing roller 21 and is less likely to be transported along the pressure belt 22 than at the end portions of the pressure belt 22 in the width direction.

Therefore, as illustrated in FIG. 5B, even when the cross-sectional shape of the middle portion of the pressure belt 22 in the width direction includes an arc shape having a curvature smaller than that of each of the end portions in the width direction, the sheet P is less likely to become wound around the middle portion of the pressure belt 22 in the width direction.

In this example, the circumference of the middle portion of the pressure belt 22 in the width direction is substantially the same as that of each of the end portions of the pressure belt 22 in the width direction. Thus, in the case where the cross-sectional shape of the middle portion of the pressure belt 22 in the width direction includes an arc shape and that of each of the end portions of the pressure belt 22 in the width direction includes an elliptical arc shape, the speed of the middle portion at the nip N is the same as that of each of the end portions at the nip N, in contrast to the case where the circumference of the middle portion of the pressure belt 22 in the width direction is different from that of the end portions of the pressure belt 22 in the width direction. As a result, the surface of the middle portion of the pressure belt 22 in the width direction and the surface of each of the end portions of the pressure belt 22 in the width direction are restrained from being abraded by the surface of the fixing roller 21 in the nip N.

As illustrated in FIGS. 4A to 4C, in the pressure belt 22 having the first shape, each of the end portions of the pressure belt 22 in the width direction includes an arc shape having a diameter smaller than that of the middle portion of the pressure belt 22 in the width direction. As illustrated in FIGS. 5A to 5C, in the pressure belt 22 having the second shape, each of the end portions of the pressure belt 22 in the width direction includes an elliptical arc shape having a minor axis extending along the sheet transport direction.

However, it is sufficient that the cross-sectional shape of each of the end portions of the pressure belt 22 in the width direction include a curve having a curvature smaller than that of the middle portion of the pressure belt 22 in the width direction on at least the downstream side of the nip N in the sheet transport direction. That is, when a part of the circumference of each of the end portions of the pressure belt 22 in the width direction corresponding to the downstream side of the nip N in the sheet transport direction has the aforementioned arc shape, the sheet P is restrained from becoming wound around the pressure belt 22.

In the examples illustrated in FIGS. 4A to 5C, the cross-sectional shape of the pressure belt 22 includes an arc shape or an elliptical arc shape. However, as long as the curvature of the cross-sectional shape of each of the end portions of the pressure belt 22 in the width direction is larger than that of the middle portion of the pressure belt 22 in the width direction on the downstream side of the nip N in the sheet transport direction, the cross-sectional shape may include a curve other than an arc or an elliptical arc.

Next, the structure of the fixing device 20 for realizing the aforementioned shape of the pressure belt 22 will be described.

Figure 6:
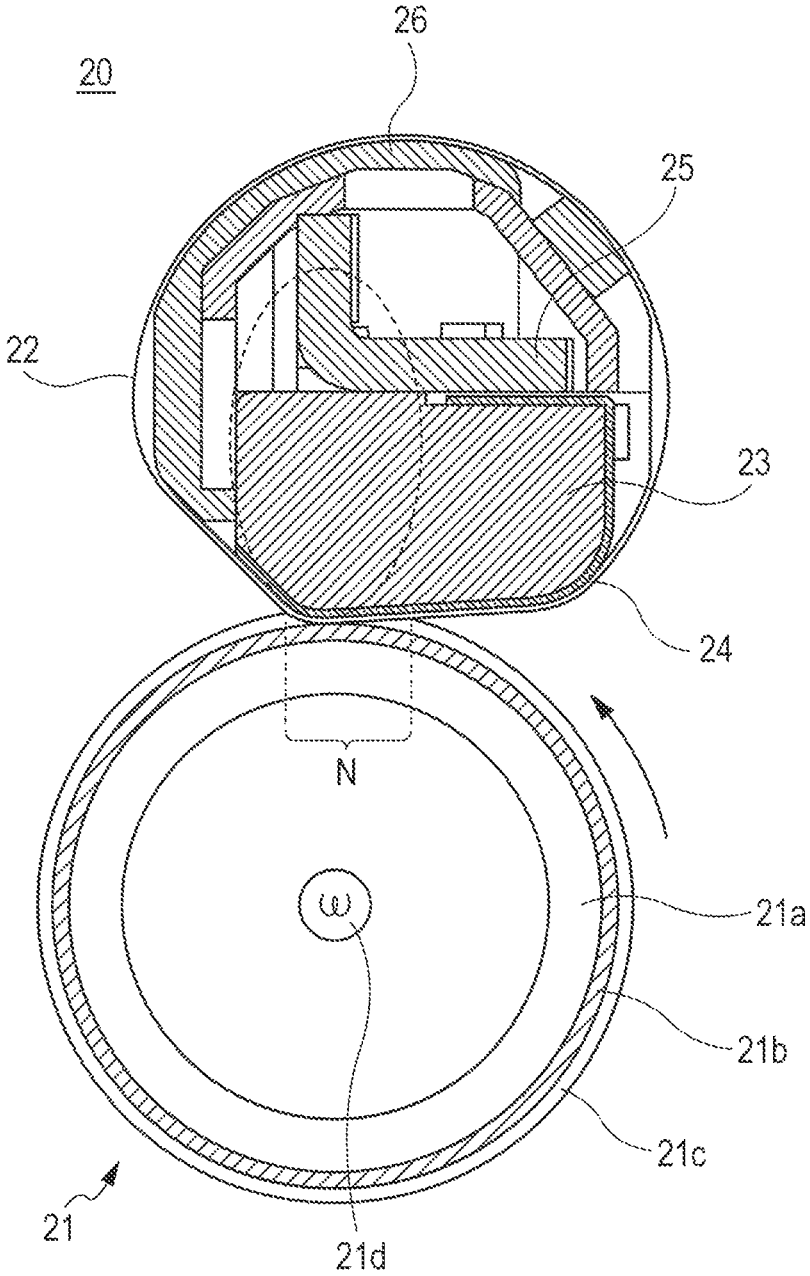
FIG. 6 is a cross-sectional view taken along line VI-VI of FIG. 2A.

FIG. 6 is a cross-sectional view taken along line VI-VI of FIG. 2A. That is, FIG. 6 is a cross-sectional view of the fixing device 20 at an end portion of the pressure belt 22 in the width direction.

As illustrated in FIGS. 6 and 3, the pressure belt 22 according to the exemplary embodiment has a shape that is curved such that, on the downstream side of the nip N in the sheet transport direction (in the output region), the curvature of the cross-sectional shape of each of the end portions of the pressure belt 22 in the width direction is larger than that of the middle portion of the pressure belt 22 in the width direction.

To be specific, in the example illustrated in FIG. 3, on the downstream side of the nip N in the sheet transport direction, the cross-sectional shape of the middle portion of the pressure belt 22 in the width direction is an arc shape. In contrast, in the example illustrated in FIG. 6, on the downstream side of the nip N in the sheet transport direction, the cross-sectional shape of each of the end portions of the pressure belt 22 in the width direction is an elliptical arc having a minor axis extending in the sheet transport direction. Thus, the curvature of the cross section of each of the end portions of the pressure belt 22 in the width direction is larger than that of the middle portion of the pressure belt 22 in the width direction.

As illustrated in FIGS. 6 and 3, in the exemplary embodiment, in an entry portion of the nip N through which the sheet P enters into the nip N and on the upstream side of the nip N in the sheet transport direction (in the entry region), the cross-sectional shape of the middle portion the pressure belt 22 in the width direction is substantially the same as that of each of the end portions of the pressure belt 22 in the width direction. Thus, in the nip N, both the middle portion of the pressure belt 22 in the width direction and the end portions of the pressure belt 22 in the width direction are capable of fixing a toner image onto the sheet P with substantially uniform performance.

As described above, in the exemplary embodiment, the pressure belt 22 is looped over the pressing pad 23 and the belt support member 26. In the exemplary embodiment, the cross-sectional shape of the pressure belt 22 taken along a plane perpendicular to the width direction is determined by the shapes of the pressing pad 23 and the belt support member 26.

Therefore, in the exemplary embodiment, the cross-sectional shape of each of the end portions the pressure belt 22 in the width direction is made different from that of the middle portion of the pressure belt 22 in the width direction by making the cross-sectional shapes of each of end portions of the pressing pad 23 and the belt support member 26 in the width direction be different from those of the middle portions in the width direction.

To be specific, in an entry portion of the nip N and on the upstream side of the nip N in the sheet transport direction (in the entry region), the pressure belt 22 is looped over the pressing pad 23, and the cross-sectional shape of the pressure belt 22 is determined by the cross-sectional shape of the pressing pad 23. In the exemplary embodiment, as illustrated in FIGS. 3 and 6, in a region in which the pressing pad 23 faces the entry portion of the nip N and the upstream side of the nip N in the sheet transport direction with the pressure belt 22 therebetween, the shape of the middle portion of the pressing pad 23 in the width direction is different from that of each of end portions of the pressing pad 23 in the width direction. Therefore, in the entry portion of the nip N and on the upstream side of the nip N in the sheet transport direction, the cross-sectional shape of the middle portion of the pressure belt 22 in the width direction is substantially the same as that of each of the end portions of the pressure belt 22 in the width direction.

On the other hand, on the downstream side of the nip N in the sheet transport direction (in the output region), the pressure belt 22 is looped over the pressing pad 23 and the belt support member 26.

To be specific, on the downstream side of the nip N in the sheet transport direction, the middle portion of the pressure belt 22 in the width direction is looped over the pressing pad 23 and the belt support member 26. Since the pressure belt is looped over the pressing pad 23 and the belt support member 26, on the downstream side of the nip N in the sheet transport direction, the cross-sectional shape of the pressure belt 22 is an arc shape protruding toward the outer periphery of the pressure belt 22.

At each of the end portions of the pressure belt 22 in the width direction, the pressure belt 22 on the downstream side of the nip N is looped over the pressing pad 23, so that the cross-sectional shape of the pressure belt 22 is determined by the cross-sectional shape of the pressing pad 23. In the exemplary embodiment, the cross-sectional shape of a portion of the pressing pad 23 that faces the downstream side of the nip N in the sheet transport direction in each of end portions in the width direction with the pressure belt 22 therebetween is an elliptical arc having a minor axis extending in the sheet transport direction in the nip N. Therefore, in each of the end portions of the pressure belt 22 in the width direction, the curvature of the cross-sectional shape of the pressure belt 22 on the downstream side of the nip N in the sheet transport direction is larger than that of the aforementioned cross-sectional shape of the middle portion of the pressure belt 22 in the width direction, which is determined by the pressing pad 23 and the belt support member 26.

As heretofore described, in the exemplary embodiment, on the downstream side of the nip N in the sheet transport direction (in the output region), the curvature of the cross-sectional shape of each of the pressure belt 22 in the width direction is larger than that of the middle portion of the pressure belt 22 in the width direction. Thus, the sheet P is restrained from becoming wound around the end portions of the pressure belt 22 in the width direction.

Since the sheet P is restrained from becoming wound around the pressure belt 22, the surface releasing layer of the pressure belt 22 need not have high releasability, and therefore the surface releasing layer may be made from a material that has a lower abrasion resistance and that is less expensive.

In the pressure belt 22 according to the exemplary embodiment, on the upstream side of the nip N in the sheet transport direction (in the entry region), the cross-sectional shape of the middle portion of the pressure belt 22 in the width direction is substantially the same as that of each of the end portions of the pressure belt 22 in the width direction. Therefore, as compared with the case where such a structure is not used, both the middle portion of the pressure belt 22 in the width direction and the end portions of the pressure belt 22 in the width direction are capable of fixing a toner image onto the sheet P with substantially uniform performance.

In the exemplary embodiment, the fixing roller 21 is used as a fixing member that faces the pressing pad 23 with the pressure belt 22 therebetween to form the nip N. However, the shape of the fixing member is not limited to a roller-like shape. For example, a belt-shaped member that is looped over plural rollers or the like may be used as the fixing member.

In the exemplary embodiment, the cross-sectional shapes of the middle portion the pressure belt 22 in the width direction and that of the each of end portions of the pressure belt 22 in the width direction are determined by looping the pressure belt 22 over the pressing pad 23 and the belt support member 26. However, the cross-sectional shape of the pressure belt 22 may be determined by using a member that is different from the pressing pad 23 and the belt support member 26.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that is rotatable and heated by a heater;

an endless belt member that is rotatable and disposed so as to be in contact with the fixing member; and a pressing member that is disposed inside of the belt member, the pressing member pressing the fixing member with the belt member therebetween so as to form a fixing nip between the fixing member and the belt member, the fixing nip allowing a recording medium to pass therethrough to fix a toner image onto the recording medium, wherein, in an output region of the fixing nip from which the recording medium is output from the fixing nip, a curvature of a cross-sectional shape of an end portion of the belt member in a width direction is larger than a curvature of a cross-sectional shape of a middle portion of the belt member in the width direction.

2. The fixing device according to claim 1, wherein a curvature of a cross-sectional shape of the belt member of the end portion of the belt member in the width direction in an entry region of the fixing nip is different from the curvature of the cross-sectional shape of the end portion of the belt member in the width direction in the output region, the entry region being a region through which the recording medium enters the fixing nip, and at least the curvature of the cross-sectional shape of the end portion in the width direction in the output region is larger than the curvature of the cross-sectional shape of the middle portion in the width direction.

3. The fixing device according to claim 2, wherein a cross-sectional shape of the middle portion of the belt member in the width direction in the entry region of the fixing nip is substantially the same as the cross-sectional shape of the end portion of the belt member in the width direction in the entry region.

4. The fixing device according to claim 1, wherein, in the output region, the cross-sectional shape of the middle portion of the belt member in the width direction includes an arc shape, and the cross-sectional shape of the end portion of the belt member in the width direction includes an arc shape having a diameter smaller than a diameter of the arc shape of the middle portion.

5. The fixing device according to claim 2, wherein, in the output region, the cross-sectional shape of the middle portion of the belt member in the width direction includes an arc shape, and the cross-sectional shape of the end portion of the belt member in the width direction includes an arc shape having a diameter smaller than a diameter of the arc shape of the middle portion.

6. The fixing device according to claim 3, wherein, in the output region, the cross-sectional shape of the middle portion of the belt member in the width direction includes an arc shape, and the cross-sectional shape of the end portion of the belt member in the width direction includes an arc shape having a diameter smaller than a diameter of the arc shape of the middle portion.

7. The fixing device according to claim 1, wherein, in the output region, the cross-sectional shape of the middle portion of the belt member in the width direction includes an arc shape, and the cross-sectional shape of the end portion of the belt member in the width direction includes an elliptical arc shape.

8. The fixing device according to claim 2, wherein, in the output region, the cross-sectional shape of the middle portion of the belt member in the width direction includes an arc shape, and the cross-sectional shape of the end portion of the belt member in the width direction includes an elliptical arc shape.

9. The fixing device according to claim 3, wherein, in the output region, the cross-sectional shape of the middle portion of the belt member in the width direction includes an arc shape, and the cross-sectional shape of the end portion of the belt member in the width direction includes an elliptical arc shape.

10. An image forming apparatus comprising:

a toner image forming unit that forms a toner image;

a transfer unit that transfers the toner image formed by the toner image forming unit to a recording medium; and a fixing unit that fixes the toner image transferred to the recording medium by the transfer unit onto the recording medium, wherein the fixing unit includes a fixing member that is rotatable and heated by a heater, an endless belt member that is rotatable and disposed so as to be in contact with the fixing member, and a pressing member that is disposed inside of the belt member, the pressing member pressing the fixing member with the belt member therebetween so as to form a fixing nip between the fixing member and the belt member, the fixing nip allowing a recording medium to pass therethrough to fix a toner image onto the recording medium, and wherein, in an output region of the fixing nip from which the recording medium is output from the fixing nip, a curvature of a cross-sectional shape of an end portion the belt member in a width direction is larger than a curvature of a cross-sectional shape of a middle portion of the belt member in the width direction, each of the cross-sectional shapes being defined by the pressing member and taken along a plane extending in a direction that intersects the width direction of the belt member and extending in a transport direction of the recording medium in the fixing nip.

* * * * *